US009373478B2

(12) United States Patent
Tamura et al.

(10) Patent No.: US 9,373,478 B2
(45) Date of Patent: Jun. 21, 2016

(54) RADIATION GENERATING APPARATUS AND RADIATION IMAGING APPARATUS

(75) Inventors: Miki Tamura, Kawasaki (JP); Kazuyuki Ueda, Tokyo (JP); Takao Ogura, Yokohama (JP); Yasue Sato, Machida (JP); Ichiro Nomura, Atsugi (JP); Shuji Aoki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 109 days.

(21) Appl. No.: 13/884,370

(22) PCT Filed: Nov. 1, 2011

(86) PCT No.: PCT/JP2011/075645

§ 371 (c)(1),
(2), (4) Date: May 9, 2013

(87) PCT Pub. No.: WO2012/077445

PCT Pub. Date: Jun. 14, 2012

(65) Prior Publication Data

US 2013/0235975 A1 Sep. 12, 2013

(30) Foreign Application Priority Data

Dec. 10, 2010 (JP) ..... 2010-275619
Dec. 10, 2010 (JP) ..... 2010-275621

(51) Int. Cl.
*H01J 35/12* (2006.01)

(52) U.S. Cl.
CPC ..... *H01J 35/12* (2013.01); *H01J 2235/087* (2013.01); *H01J 2235/1291* (2013.01); *H01J 2235/186* (2013.01)

(58) Field of Classification Search
CPC ..... H01J 35/16; H01J 2235/186; H01J 2235/087; H01J 2235/1204; H01J 35/12; H01J 35/18; H01J 2235/165; A61B 6/032
See application file for complete search history.

(56) References Cited

U.S. PATENT DOCUMENTS 2,019,602 A * 11/1935 Findlay ..... 378/202
2,168,780 A * 8/1939 Oishevsky ..... 378/140

(Continued)

FOREIGN PATENT DOCUMENTS

JP 54-006882 1/1979
JP S62-121773 U 8/1987

(Continued)

OTHER PUBLICATIONS

Japanese Office Action issued in counterpart application No. 2010-275621 dated Jul. 15, 2014, along with its English-language translation—4 pages.

(Continued)

*Primary Examiner* — Glen Kao
*Assistant Examiner* — Chih Cheng Kao
(74) *Attorney, Agent, or Firm* — Fitzpatrick, Cella, Harper & Scinto

(57) ABSTRACT

There is provided a radiation generating apparatus having a simple structure and capable of shielding unnecessary radiation, cooling a target, reducing the size and weight of the apparatus, and achieving higher reliability, and a radiation imaging apparatus having the same. A transmission type radiation tube is held inside a holding container filled with a cooling medium. The transmission type radiation tube includes an envelope having an aperture, an electron source arranged inside the envelope so as to face the aperture of the envelope, a target unit for generating a radiation responsive to an irradiation with an electron emitted from the electron source, and a shield member for shielding a part of the radiation emitted from the target unit. The cooling medium contacts at least a part of the shield member.

44 Claims, 4 Drawing Sheets

(56) References Cited

U.S. PATENT DOCUMENTS

| | | | | |
|---|---|---|---|---|
| 4,034,251 | A * | 7/1977 | Haas | 378/140 |
| 4,104,531 | A | 8/1978 | Weiss | |
| 4,400,824 | A | 8/1983 | Shidara | |
| 5,148,462 | A * | 9/1992 | Spitsyn et al. | 378/143 |
| 6,188,747 | B1 | 2/2001 | Geus et al. | |
| 7,991,120 | B2 | 8/2011 | Okunuki et al. | |
| 8,472,585 | B2 | 6/2013 | Ogura et al. | |
| 2006/0165220 | A1 * | 7/2006 | Takahashi et al. | 378/109 |
| 2007/0025516 | A1 * | 2/2007 | Bard et al. | 378/138 |
| 2008/0232718 | A1 * | 9/2008 | Avinash et al. | 382/305 |
| 2009/0010393 | A1 | 1/2009 | Klinkowstein et al. | 378/140 |
| 2010/0246766 | A1 | 9/2010 | Kindlein et al. | 378/65 |
| 2012/0140895 | A1 | 6/2012 | Okunuki et al. | 378/122 |
| 2012/0307974 | A1 | 12/2012 | Yamazaki et al. | |
| 2012/0307978 | A1 | 12/2012 | Yamazaki et al. | |
| 2013/0016810 | A1 | 1/2013 | Tamura et al. | |
| 2013/0016811 | A1 | 1/2013 | Ueda et al. | |
| 2013/0016812 | A1 | 1/2013 | Yanagisawa et al. | |
| 2013/0034207 | A1 | 2/2013 | Aoki et al. | |
| 2013/0148781 | A1 | 6/2013 | Yamazaki et al. | |
| 2013/0230143 | A1 | 9/2013 | Ueda et al. | |

FOREIGN PATENT DOCUMENTS

| | | | |
|---|---|---|---|
| JP | 07057668 | A * | 3/1995 |
| JP | 2003505845 | A | 2/2003 |
| JP | 2005523558 | A | 8/2005 |
| JP | A 2007-265981 | | 10/2007 |
| JP | A 2009-043651 | | 2/2009 |
| JP | 2009205992 | A | 9/2009 |
| WO | 2006009053 | A1 | 1/2006 |

OTHER PUBLICATIONS

Chinese Office Action issued in counterpart application No. 201180058655.9 dated Mar. 16, 2015, along with its English-language translation (15 pages).

Communication dated Jul. 10, 2015 in European Application No. 11793509.8 (4 pages).

* cited by examiner

RADIATION GENERATING APPARATUS AND RADIATION IMAGING APPARATUS

TECHNICAL FIELD

The present invention relates to a radiation generating apparatus applicable to non-destructive X-ray imaging or the like in the fields of medical devices and industrial equipment, and a radiation imaging apparatus having the radiation generating apparatus.

BACKGROUND ART

A radiation tube (radiation generating tube) accelerates electrons emitted from an electron source to high energy and irradiates a target with the accelerated electrons to generate radiation such as X-rays. The radiation generated at this time is emitted in all directions. In light of this, a container holding the radiation tube or the circumference of the radiation tube is covered with a shield member (radiation shielding member) such as lead so as to prevent unnecessary radiation from leaking outside. Thus, it has been difficult to reduce the size and weight of such a radiation tube and a radiation generating apparatus holding the radiation tube.

Japanese Patent Application Laid-Open No. 2007-265981 discloses a transmission type multi X-ray generating apparatus for shielding unnecessarily emitted X-rays by arranging shields each on an X-ray emission side and an electron incident side of the target.

It has been difficult for such a target (anode)-fixed type transmission type radiation tube to generate high-energy radiation because the target has a relatively low heat radiation. The X-ray generating apparatus disclosed in Japanese Patent Application Laid-Open No. 2007-265981 is configured such that the target is bonded to the shield member, which allows heat generated in the target to be transferred to and dissipated through the shield member, thereby suppressing an increase in temperature of the target.

CITATION LIST

Patent Literature

PTL1: Japanese Patent Application Laid-Open No. 2007-265981

SUMMARY OF INVENTION

Technical Problem

However, a conventional transmission type radiation tube is configured such that the shield member is placed inside a vacuum chamber, which limits a region for transferring heat from the shield member to outside the vacuum chamber. Accordingly, the heat radiation of the target is not necessarily sufficient, leading to a problem in achieving a balance between a target cooling capability and a compact lightweight apparatus.

Solution to Problem

It is an object of the present invention to provide a radiation generating apparatus which is small in size, light in weight, excellent in heat radiation, and high in reliability, and a radiation imaging apparatus having the same.

In order to achieve the above object, a radiation generating apparatus according to the present invention comprises: a holding container; a transmission type radiation tube arranged in the holding container; and a cooling medium filling between the holding container and the transmission type radiation tube, wherein the transmission type radiation tube includes an envelope having an aperture, an electron source arranged in the envelope, a target unit arranged at the aperture, for generating a radiation responsive to an irradiation with an electron emitted from the electron source, and a shield member arranged at the aperture so as to surround the target unit for shielding a part of the radiation emitted from the target unit, wherein at least a part of the shield member contacts the cooling medium.

Advantageous Effect of Invention

The present invention is configured such that a shield member is bonded to a target unit and at least a part of the shield member contacts a cooling medium so that heat generated in the target unit is transferred to the shield member, through which the heat is transferred to the cooling medium for quick heat dissipation. Further, a thermal insulating member is interposed between the target unit and the cooling medium, thereby suppressing deterioration of the cooling medium due to local overheating because heat transfer from a surface of the target unit to the cooling medium is controlled. This can provide a radiation generating apparatus having a simple structure and capable of shielding the unnecessary radiation and cooling the target. Further, the size of a member for shielding the unnecessary radiation can be reduced, and thus reduction in size and weight of the entire radiation generating apparatus can be achieved. Furthermore, suppression of deterioration of the cooling medium due to overheating allows the pressure resistance of the cooling medium to be maintained for a long period of time, thus enabling a more highly reliable radiation generating apparatus to be provided.

Further features of the present invention will become apparent from the following description of exemplary embodiments with reference to the attached drawings.

DESCRIPTION OF EMBODIMENTS

Hereinafter, embodiments of the present invention will be described using drawings, but the present invention is not limited to these embodiments. Further, the radiation for use in the radiation generating apparatus of the present invention includes not only X-rays but also neutron radiation and γ radiation.

Figure 1:
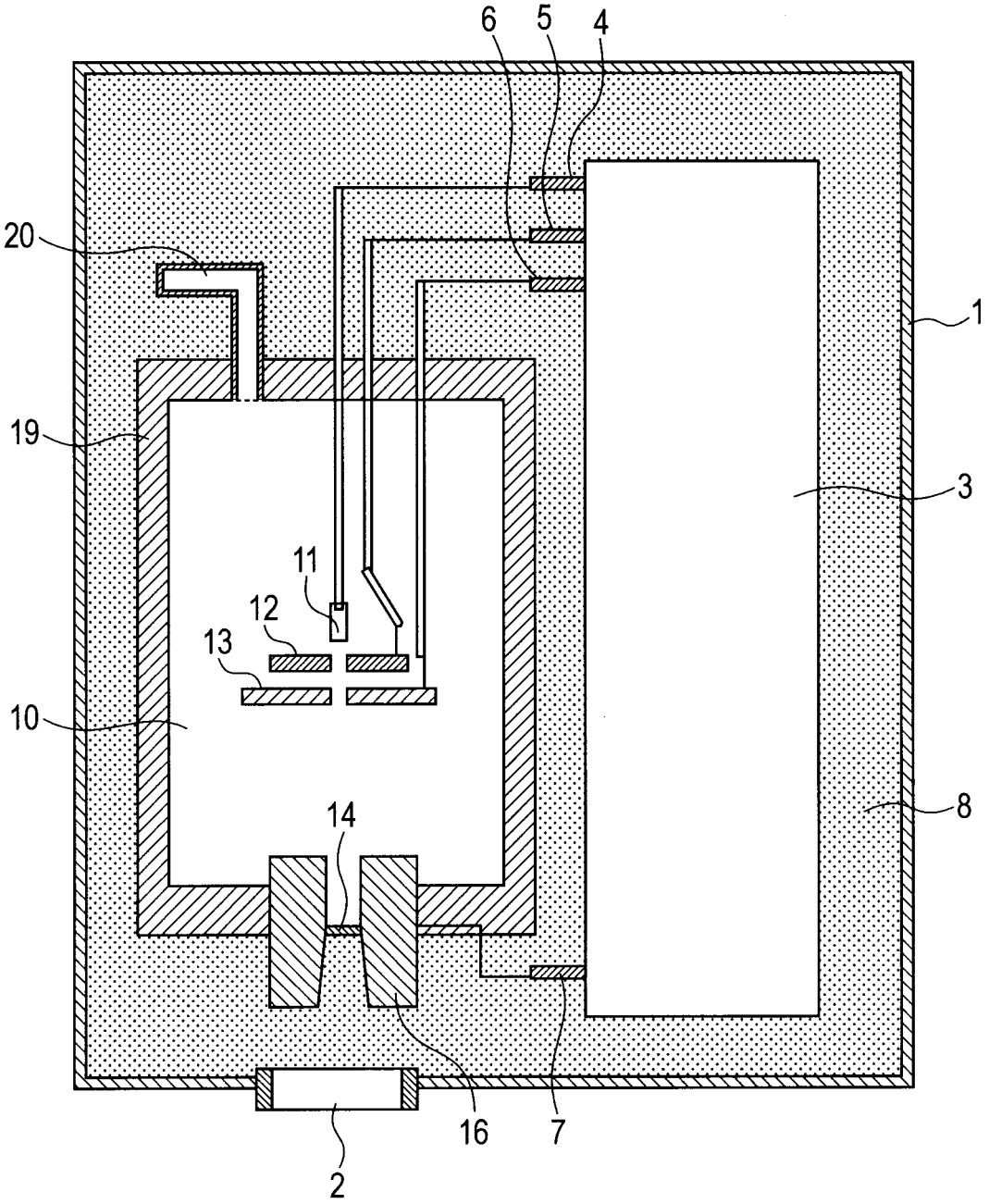
FIG. 1 is a schematic view of a radiation generating apparatus of the present invention.

FIG. 1 is a schematic view of the radiation generating apparatus (X-ray generating apparatus) of the present invention. A transmission type radiation tube 10 (hereinafter referred to as an X-ray tube) is held inside a holding container 1. The remaining space inside the holding container 1 holding the X-ray tube 10 therein is filled with a cooling medium 8. The holding container 1 includes thereinside a voltage control unit 3 (voltage control unit) having a circuit board, an isolation transformer, and the like. A cathode control signal, an electron extraction control signal, an electron beam converging control signal, and a target control signal are applied from the voltage control unit 3 to the X-ray tube through terminals 4, 5, 6, and 7 respectively to control X-ray generation.

The holding container 1 may have a sufficient strength as a container and is made of metal, plastics, and the like. The holding container 1 may include a radiation transmission window 2 made of glass, aluminum, beryllium, and the like as the present embodiment. When the radiation transmission window 2 is provided, the radiation emitted from the X-ray tube 10 is radiated outside through the radiation transmission window 2.

The cooling medium 8 may have electrical insulation. For example, an electrical insulating oil can be used which serves as an insulating medium and a cooling medium for cooling the X-ray tube 10. A mineral oil, a silicone oil, and the like are preferably used for the electrical insulating oil. The other available examples of the cooling medium 8 may include a fluorine series electric insulator.

The X-ray tube 10 includes an envelope 19, an electron source 11, a target unit 14, and a shield member 16. The X-ray tube 10 further includes an extraction electrode 12 and a lens electrode 13. An electric field generated by the extraction electrode 12 causes electrons to be emitted from the electron source 11. The emitted electrons are converged by the lens electrode 13 and are incident on the target unit 14 to generate radiation. The X-ray tube 10 may further include an exhaust pipe 20 like the present embodiment. When the exhaust pipe 20 is provided, for example, the inside of the envelope 19 is exhausted to vacuum through the exhaust pipe 20 and then a part of the exhaust pipe 20 is sealed, thereby enabling the inside of the envelope 19 to be vacuum.

The envelope 19 is provided to maintain vacuum inside the X-ray tube 10 and is made of glass, ceramics, and the like. The degree of vacuum inside the envelope 19 may be about $10^{-4}$ to $10^{-8}$ Pa. The envelope 19 may include thereinside an unillustrated getter to maintain the degree of vacuum. The envelope 19 further includes an aperture. The shield member 16 is bonded to the aperture. The shield member 16 has a path communicating with the aperture of the envelope 19. The target unit 14 is bonded to the path to hermetically seal the envelope 19.

The electron source 11 arranged inside the envelope 19 so as to face the aperture of the envelope 19. A hot cathode such as a tungsten filament and an impregnated cathode or a cold cathode such as a carbon nanotube can be used as the electron source 11. The extraction electrode 12 is arranged near the electron source 11. The electrons emitted by an electric field generated by the extraction electrode 12 are converged by the lens electrode 13 and are incident on the target 14 to generate radiation. An accelerating voltage Va applied to between the electron source 11 and the target 14 is different depending on the intended use of the radiation, but is roughly about 40 to 120 kV.

Figure 2A:
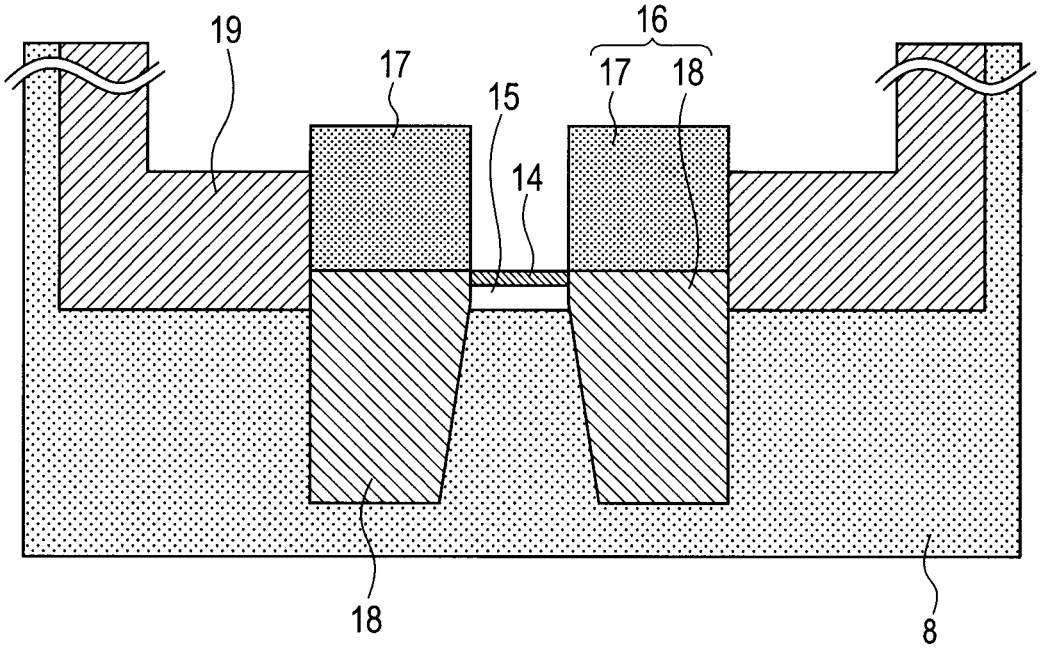
FIGS. 2A, 2B, 2C, 2D, and 2E are schematic views illustrating a configuration around a target unit of the present invention.

As illustrated in FIG. 2A, the target unit may include a target 14 and a transmission plate 15. The transmission plate 15 supports the target 14 and transmits at least a part of the radiation generated in the target 14. The transmission plate 15 is arranged in a path of the shield member 16 communicating with the aperture of the envelope 19. The material forming the transmission plate 15 preferably has sufficient strength to support the target 14, absorbs less radiation generated in the target 14, and has high thermal conductivity so as to quickly dissipate heat generated in the target 14. For example, diamond, silicon nitride, aluminum nitride, and the like can be used. In order to satisfy the above requirement for the transmission plate 15, the thickness of the transmission plate 15 is appropriately about 0.1 mm to 10 mm. The transmission plate 15 may be integrally formed with the target 14.

The target 14 is arranged on a surface (inner surface side) of the transmission plate 15 facing the electron source side. The material forming the target 14 preferably has a high melting point and a high radiation generation efficiency. For example, tungsten, tantalum, molybdenum, and the like can be used. In order to reduce the radiation absorbed when the generated radiation passes through the target 14, the thickness of the target 14 is appropriately about 1 μm to 20 μm.

The shield member 16 shields a part of the radiation emitted from the target 14. The shield member 16 is arranged in the aperture of the envelope 19 so as to surround the target unit 14. The shield member 16 is connected to the target unit 14 over the entire periphery thereof, but may not be necessarily connected over the entire periphery thereof depending on the arrangement relation between the shield member 16 and the target unit 14. The shield member 16 has a path communicating with the aperture and the transmission plate 15 is bonded to the path. The target 14 may not be connected to the path. The shield member 16 may include two shield members (a first shield member 17 and a second shield member 18) of a tubular shape such as a cylinder like the present embodiment.

The first shield member 17 has a function of shielding the radiation scattered toward the electron source side of the target 14 when the electrons are incident on the target 14 and the radiation is generated. The first shield member 17 has a path communicating with the aperture of the envelope 19. The electrons emitted from the electron source 11 pass through a path of the first shield member 17 communicating with the aperture of the envelope 19 and the radiation scattered toward the electron source side of the target 14 is shielded by the first shield member 17.

The second shield member 18 has a function of shielding unnecessary radiation of the radiation passing through the transmission plate 15 and emitted therefrom. The second shield member 18 has a path communicating with the aperture of the envelope 19. The radiation passing through the transmission plate 15 passes through a path of the second shield member 18 communicating with the aperture of the envelope 19, and the unnecessary radiation is shielded by the second shield member 18.

FIGS. 2A to 2E are schematic views around the target unit 14. In the present embodiment, as illustrated in FIGS. 2A to 2E, the sectional area of the path of the second shield member 18 can gradually increase toward the opposite side of the electron source from the transmission plate 15 (the more away from the transmission plate 15, the more the area increases). The reason for this is that the radiation passing through the transmission plate 15 is radially radiated.

Further, in the present embodiment, it is preferable that between the electron source side from the transmission plate 15 and the opposite side of the electron source from the transmission plate 15, the center of gravity of the opening of the path on each side matches (the center of gravity of the opening of the path of the first shield member 17 matches the center of gravity of the opening of the path of the second shield member 18). More specifically, as illustrated in FIGS. 2A to 2E, the opening of the path of the first shield member 17 and the opening of the path of the second shield member 18 are preferably arranged on the same straight line perpendicular to the surface on which the target of the transmission plate 15 is placed with the transmission plate 15 interposed therebetween. This is because in the present embodiment, the target 14 irradiated with electrons to generate radiation and the radiation passing through the transmission plate 15 is emitted.

The material forming the shield member 16 (the first shield member 17 and the second shield member 18) preferably has a high radiation absorption rate and a high thermal conductivity. For example, a metal material such as tungsten and tantalum can be used. In order to sufficiently shield unnecessary radiation and prevent an unnecessary increase in size around the target, the thickness of the first shield member 17 and the second shield member 18 is appropriately 3 mm to 20 mm.

An anode grounding system and a neutral grounding system may be used as the voltage control unit for use in the radiation generating apparatus of the present embodiment, but the neutral grounding system is preferably used. The anode grounding system is such that assuming that an accelerating voltage applied between the target 14 and the electron source 11 is Va[V], the voltage of the target 14 serving as the anode is set to ground (0[V]) and the voltage of the electron source 11 is set to −Va[V]. In contrast to this, the neutral grounding system is such that the voltage of the target 14 is set to +(Va−α)[V] and the voltage of the electron source 11 is set to −α[V] (where Va>α>0). Any value in the range of Va>α>0 may be set to α, but Va/2 is preferable. The use of the neutral grounding system can reduce the absolute value of the voltage with respect to ground and can shorten the creeping distance. Here, the creeping distance means a distance between the voltage control unit 3 and the holding container 1, and a distance between the X-ray tube 10 and the holding container 1. A reduction in the creeping distance can reduce the size of the holding container 1, which can reduce the weight of the cooling medium 8 by the reduced size, thus leading to a further reduction in size and weight of the radiation generating apparatus.

First Embodiment

FIG. 2A illustrates a configuration around the target unit 14 of the present embodiment. The target 14 is in a mechanical and thermal contact with the first shield member 17 and the second shield member 18 directly or through the transmission plate 15. A surface of the transmission plate 15 on the opposite side (outer surface side) of the electron source and the second shield member 18 form a part of an outer wall of the envelope 19 and is located inside the holding container 1 in a direct contact with the cooling medium 8. Consequently, the heat generated when electrons are incident on the target 14 is dissipated from the surface of the transmission plate 15 on the opposite side of the electron source to the cooling medium 8 and at the same time is quickly dissipated to the cooling medium 8 through the second shield member 18 as well. Thus, an increase in temperature of the target 14 is suppressed.

Thus, the present embodiment can extremely improve the target cooling effects.

The radiation generating apparatus of the present embodiment may be configured such that the shield member 16 includes only the second shield member 18. In this case, the heat generated when electrons are incident on the target 14 is dissipated from the surface of the transmission plate 15 on the opposite side of the electron source to the cooling medium 8 and at the same time is quickly dissipated to the cooling medium 8 through the second shield member 18 as well. Thus, an increase in temperature of the target 14 is suppressed. Note that another shielding member (for example, a shielding member made of a lead plate and covering a part of the outer wall of the envelope 19) is required on the electron source side of the target 14 to shield the scattered radiation but the shielding member does not need to cover the entire surface of the radiation tube, thus enabling reduction in size and weight of the radiation generating apparatus.

Second Embodiment

In the first embodiment, the transmission plate directly contacts the cooling medium, and thus the heat generated in the target causes a sharp local increase in temperature of a portion of the cooling medium contacting the transmission plate. The local increase in temperature causes a convective flow of the cooling medium, which causes a turnover of the cooling medium on the surface of the transmission plate, but a part thereof exceeds a decomposition temperature (generally about 200 to 250° C. for the electrical insulating oil), which may decompose (deteriorate) the cooling medium. Advancement of decomposition of the cooling medium reduces the pressure resistance of the cooling medium, which has caused a problem such as discharge due to long time driving.

Figure 2B:
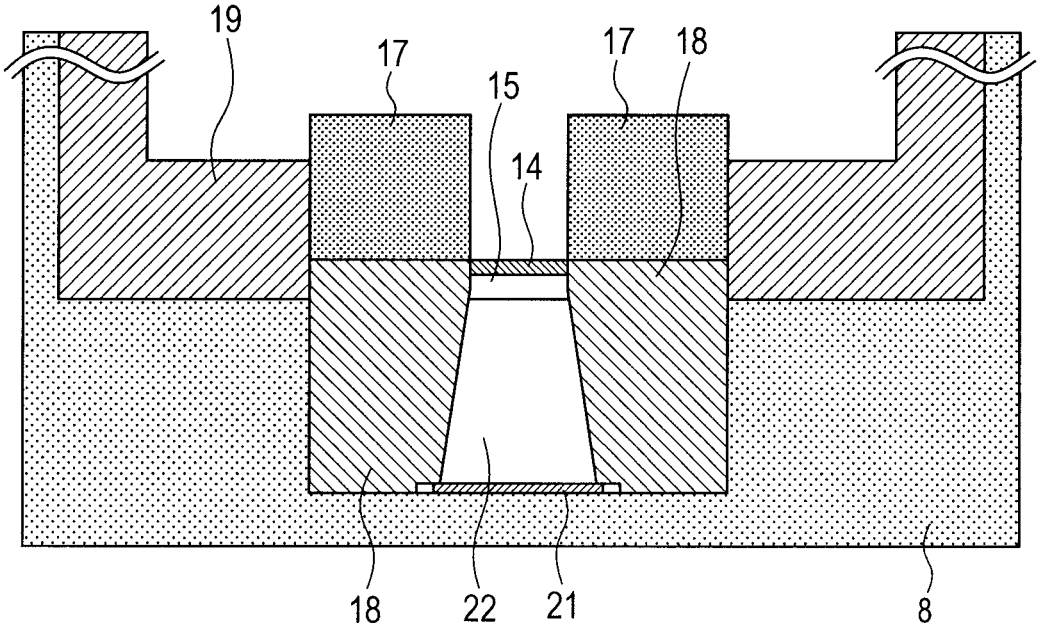

FIG. 2B illustrates a configuration around the target unit 14 of the present embodiment.

A thermal insulating member is provided on an inner surface side of the shield member 18 so as to prevent a direct contact between the transmission plate 15 and the cooling medium 8. The thermal insulating member is a space 22 formed by the transmission plate 15 and a cover plate 21 provided in an end portion of a protrusion portion of the shield member 18. The cover plate 21 is bonded to the second shield member 18. The cover plate 21 is preferably made of a material having a low radiation absorption rate such as diamond, glass, beryllium, aluminum, silicon nitride, and aluminum nitride. In order to provide the cover plate 21 with enough strength as a substrate and reduce radiation absorption, the thickness of the cover plate 21 is preferably about 100 μm to 10 mm.

The material forming the heat insulating space 22 preferably has lower thermal conductivity than those of the materials forming the second shield member 18, low radiation absorption rate, and high heat resistance, and vacuum or a gas is suitable. Examples of the gas may include air, nitrogen, an inert gas such as argon, neon, and helium. The pressure of the gas forming the heat insulating space 22 may be atmospheric pressure, but may be preliminarily set to be lower than the atmospheric pressure because the gas expands by the heat generated in the target when radiation is generated. The pressure of the gas forming the heat insulating space 22 is proportional to the absolute temperature, and thus based on the assumed temperature, a pressure at formation may be set thereto. The X-ray tube 10 of the present embodiment may be formed by bonding or welding the cover plate 21 to the second shield member 18 in a vacuum or gaseous atmosphere.

According to the present embodiment, except the inner surface side of the shield member 18, the shield member 18 directly contacts the cooling medium 8; and on the inner surface side of the shield member 18, the thermal insulating member 22 having a lower thermal conductivity than that of the second shield member 18 is formed between the transmission plate 15 and the cooling medium 8. Accordingly, the heat generated in the target 14 is transferred to the second shield member 18, through which the heat is transferred to the cooling medium 8 to be quickly dissipated therefrom. Thus, an increase in temperature of the target 14 is suppressed and at the same time the heat transfer from the transmission plate 15 to the cooling medium 8 is suppressed, thereby suppressing deterioration of the cooling medium 8 due to local overheating.

Figure 2C:
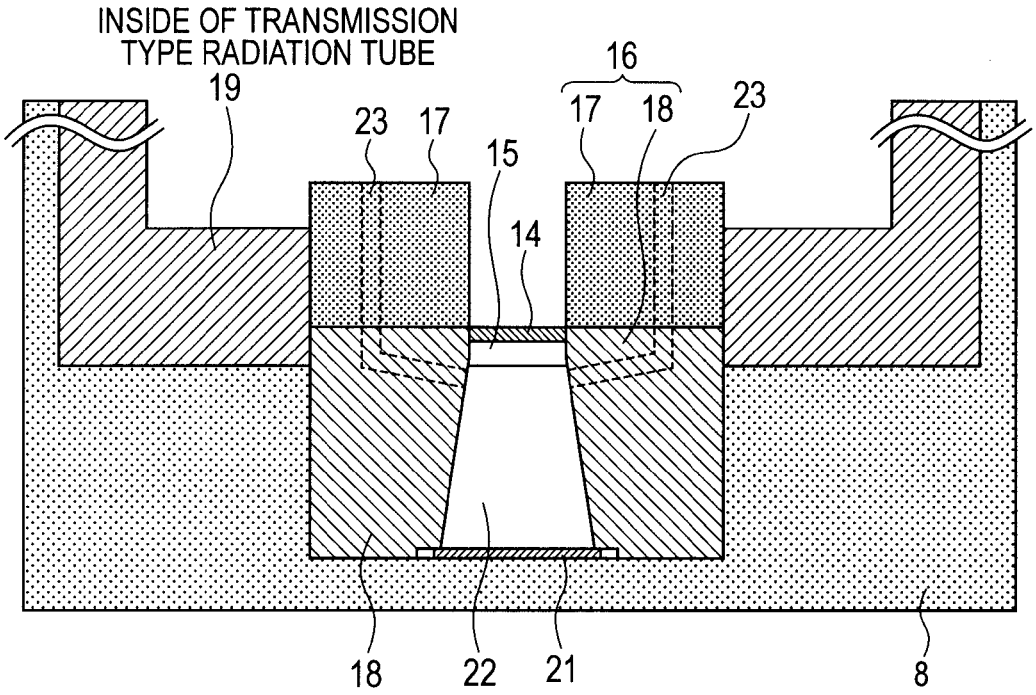

When the thermal insulating member 22 is vacuum, as illustrated in FIG. 2C, a hole (communication hole) 23 is provided in the first shield member 17 and the second shield member 18, and through the hole, the inside of the envelope 19 may be adapted to communicate with the inside of the thermal insulating member 22. When the communication hole 23 is provided, the X-ray tube 10 of the present embodiment can be formed in such a manner that after the cover plate 21 is bonded to the second shield member 18, the inside of the envelope 19 and the inside of the thermal insulating member 22 are exhausted at the same time through the exhaust pipe 20, and the exhaust pipe 20 is sealed.

Third Embodiment

Figure 2D:
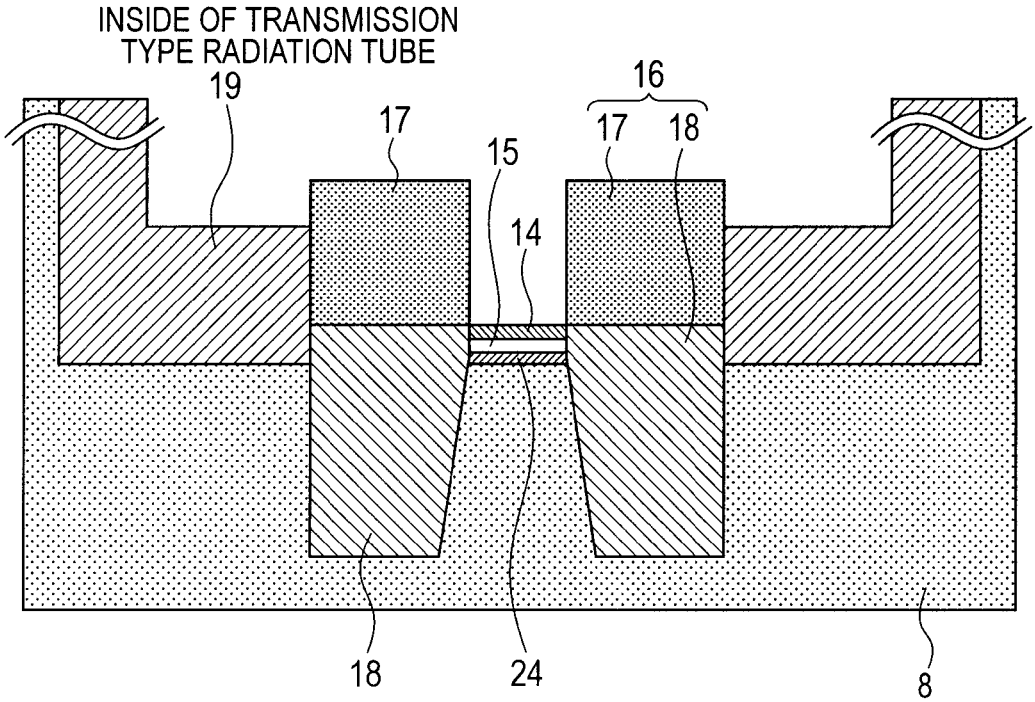

FIG. 2D illustrates a configuration around the target unit 14 of the present embodiment. The thermal insulating member interposed between the transmission plate 15 and the cooling medium 8 is made of a solid thermal insulating member 24. The other components may be the same as the components of the second embodiment.

The material forming the thermal insulating member 24 preferably has lower thermal conductivity than those of the material forming the second shield member 18, low radiation absorption rate, and high heat resistance. Examples of the material may include silicon oxide, silicon nitride, titanium oxide, titanium nitride, titanium carbide, zinc oxide, aluminum oxide, and the like. The thermal insulating member 24 may be formed by a film formation method in which any of the above materials is subjected to sputtering, deposition, CVD, sol-gel, or other processes on a surface of the transmission plate 15; or in such a manner that a substrate made of any of the above materials is attached or bonded to the surface of the transmission plate 15. In order to suppress the heat transfer between the transmission plate 15 and the cooling medium 8 and reduce the radiation absorption rate, the thickness of the thermal insulating member 24 is preferably in the range of 10 μm to 10 mm.

According to the present embodiment, the thermal insulating member 24 is formed mainly by film formation. Thus, the manufacturing process can be simplified and the manufacturing costs can be reduced.

Fourth Embodiment

Figure 2E:
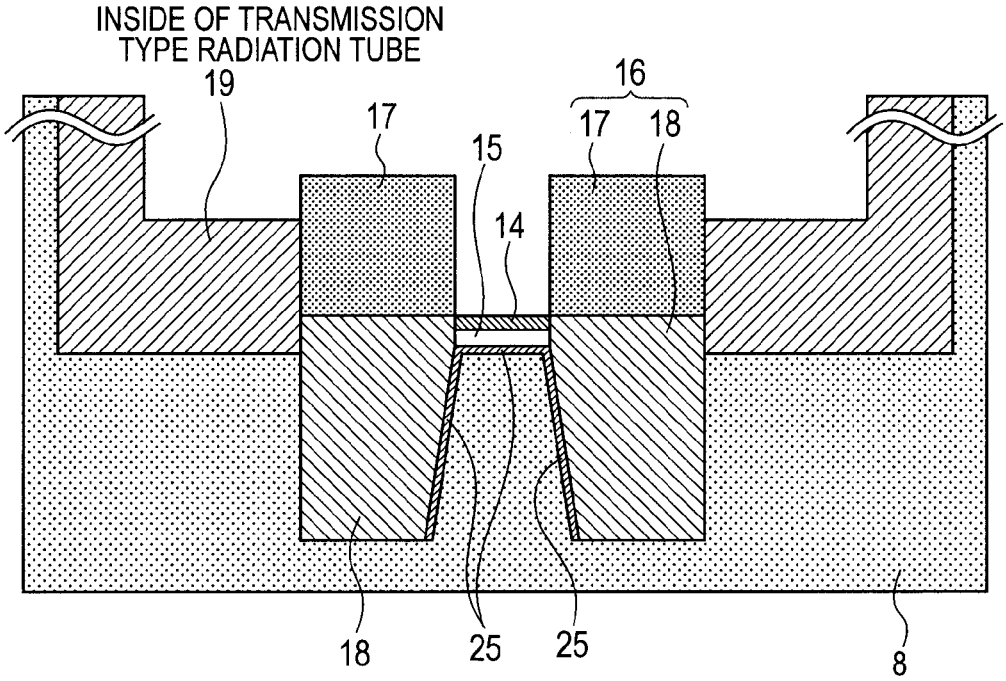

FIG. 2E illustrates a configuration around the target unit 14 of the present embodiment. The present embodiment is configured such that a thermal insulating member 25 is formed not only between the transmission plate 15 and the cooling medium 8 but also between an inner wall of a path of the second shield member 18 and the cooling medium 8. The material and the film formation method of the thermal insulating member 25 are the same as those of third embodiment.

The present embodiment can suppress the heat transfer to the cooling medium 8 not only from the transmission plate 15 but also from a relatively high temperature portion of the second shield member 18 near the transmission plate 15. Thus, the present embodiment can further suppress the deterioration of the cooling medium 8 due to overheating.

Fifth Embodiment

Figure 3:
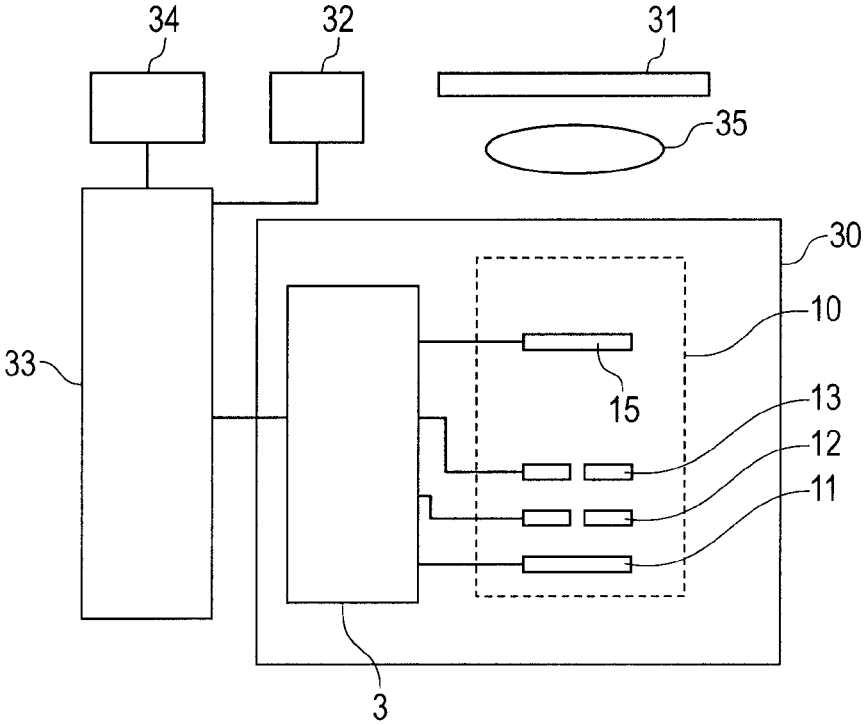
FIG. 3 is a configuration view of a radiation imaging apparatus using the radiation generating apparatus of the present invention.

FIG. 3 is a configuration view of a radiation imaging apparatus of the present embodiment. The radiation imaging apparatus includes a radiation generating apparatus 30, a radiation detector 31, a signal processing unit 32, an apparatus control unit 33, and a display unit 34. As the radiation generating apparatus 30, the radiation generating apparatus according to one of the first to fourth embodiments is used. The radiation detector 31 is connected to the apparatus control unit 33 through the signal processing unit 32. The apparatus control unit 33 is connected to the display unit 34 and the voltage control unit 3.

The process of the radiation generating apparatus 30 is integratedly controlled by the apparatus control unit 33. For example, the apparatus control unit 33 controls radiation imaging by the radiation generating apparatus 30 and the radiation detector 31. The radiation emitted from the radiation generating apparatus 30 passes through an object 35 and is detected by the radiation detector 31, in which a radiation transmission image of the object 35 is taken. The taken radiation transmission image is displayed on the display unit 34. Further, for example, the apparatus control unit 33 controls driving of the radiation generating apparatus 30 and controls a voltage signal applied to the X-ray tube 10 through the voltage control unit 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-275619, filed Dec. 10, 2010, and No. 2010-275621 filed Dec. 10, 2010, which are hereby incorporated by reference herein in their entirety.

The invention claimed is:

1. An X-ray generating apparatus comprising:

a transmission-type X-ray tube including an envelope having an aperture, an electron source arranged in said envelope, a transmitting-type target having a target layer for generating X-ray responsive to irradiation with an electron emitted from said electron source and an inner window supporting said target layer; and a tubular shield member arranged at said aperture and holding said transmitting-type target inside thereof so as to shield a part of the X-ray emitted from said transmitting-type target, a container storing said transmission-type X-ray tube inside thereof and having an outer window through which the X-ray emitted from said transmission-type X-ray tube transmits, and an electrical insulating liquid filling a space between said container and said transmission-type X-ray tube, wherein said tubular shield member has a protruding portion which protrudes outside said envelope beyond said aperture so as to contact said electrical insulating liquid, and wherein a separating member is connected to said protruding portion so as to form a thermal insulating portion between said inner window and said electrical insulating liquid and permit said electrical insulating liquid to flow across an inter-window region between said separating member and said outer window.

2. The X-ray generating apparatus according to claim 1, wherein said electrical insulating liquid is an electrical insulating oil.

3. The X-ray generating apparatus according to claim 1, wherein said transmitting-type target comprises a transmission plate of diamond.

4. The X-ray generating apparatus according to claim 1, further comprising a voltage control unit for setting a voltage of said transmitting-type target to $+(Va-\alpha)$ and a voltage of said electron source to $-\alpha$, where $Va>\alpha>0$.

5. The X-ray generating apparatus according to claim 1, wherein said transmitting-type target does not contact said electrical insulating liquid.

6. The X-ray generating apparatus according to claim 5, wherein said thermal insulating portion is arranged between said transmitting-type target and said electrical insulating liquid.

7. The X-ray generating apparatus according to claim 1, wherein said thermal insulating portion is defined at a pressure lower than atmospheric pressure.

8. The X-ray generating apparatus according to claim 1, wherein said thermal insulating portion is filled with gas at atmospheric pressure.

9. The X-ray generating apparatus according to claim 1, wherein said thermal insulating portion comprises a solid substance of a material with smaller thermal conductivity than that of a material of said tubular shield member.

10. A radiography system comprising:

an X-ray generating apparatus according to claim 1;

an X-ray detector for detecting the X-ray emitted from said X-ray generating apparatus and transmitted through an object; and a controlling unit for controlling said X-ray generating apparatus and said X-ray detector.

11. The X-ray generating apparatus according to claim 1, wherein said separating member is connected to said tubular shield member in a hermetically sealed manner so as to separate said electrical insulating liquid from said thermal insulating portion.

12. The X-ray generating apparatus according to claim 1, wherein said separating member is connected to said tubular shield member in a hermetically sealed manner so as to thermally isolate said electrical insulating liquid from said thermal insulating portion.

13. The X-ray generating apparatus according to claim 1, wherein said separating member is connected to said tubular shield member not to hinder fluidity of said insulating liquid.

14. The X-ray generating apparatus according to claim 1, wherein said separating member is a cover plate.

15. An X-ray generating apparatus comprising:

a transmission-type X-ray tube including an envelope having an aperture, an electron source arranged in said envelope, a transmission-type target having a target layer for generating X-ray responsive to irradiation with an electron emitted from said electron source; and a tubular shield member secured to said envelope at said aperture and holding said transmission-type target inside thereof so as to shield a part of the X-ray emitted from said transmission-type target, a container storing said transmission-type X-ray tube inside thereof and having a transmission window through which the X-ray emitted from said transmission-type X-ray tube transmits, an electrical insulating liquid filling a space between said container and said transmission-type X-ray tube, and a separating member separating said transmission-type target from said electrical insulating liquid, wherein said tubular shield member has a protruding portion which protrudes outwardly from said envelope toward said container so as to contact said electrical insulating liquid, and wherein said separating member is connected to said protruding portion so as to form a thermal insulating portion between said transmission-type target and said electrical insulating liquid and permit said electrical insulating liquid to flow across a region between said separating member and said transmission window.

16. The X-ray generating apparatus according to claim 15, wherein said electrical insulating liquid is an electrical insulating oil.

17. The X-ray generating apparatus according to claim 15, wherein said transmission-type target comprises a transmission plate of diamond.

18. The X-ray generating apparatus according to claim 15, further comprising a voltage control unit for setting a voltage of said transmission type target to $+(Va-\alpha)$ and a voltage of said electron source to $-\alpha$, where $Va>\alpha>0$.

19. The X-ray generating apparatus according to claim 15, wherein said thermal insulating portion is defined at a pressure lower than atmospheric pressure.

20. The X-ray generating apparatus according to claim 15, wherein said thermal insulating portion is filled with gas at atmospheric pressure.

21. The X-ray generating apparatus according to claim 15, wherein said thermal insulating portion comprises a solid substance of a material with smaller thermal conductivity than that of a material of said tubular shield member.

22. A radiography system comprising:

an X-ray generating apparatus according to claim 15;

an X-ray detector for detecting the X-ray emitted from said X-ray generating apparatus and transmitted through an object; and a controlling unit for controlling said X-ray generating apparatus and said X-ray detector.

23. The X-ray generating apparatus according to claim 15, wherein said separating member is connected to said tubular shield member in a hermetically sealed manner so as to separate said electrical insulating liquid from said thermal insulating portion.

24. The X-ray generating apparatus according to claim 15, wherein said separating member is connected to said tubular shield member in a hermetically sealed manner so as to thermally isolate said electrical insulating liquid from said thermal insulating portion.

25. The X-ray generating apparatus according to claim 15, wherein said separating member is connected to said tubular shield member not to hinder fluidity of said insulating liquid.

26. The X-ray generating apparatus according to claim 15, wherein said separating member is provided in an end portion of said protruding portion of said tubular shield member.

27. The X-ray generating apparatus according to claim 15, wherein said tubular shield member has a protruding portion which protrudes outwardly from said envelope toward said transmission window.

28. An X-ray generating apparatus comprising:

a transmission-type X-ray tube including an envelope having an aperture, a transmission-type target; and a tubular shield member secured to said envelope at said aperture and holding said transmission-type target inside thereof, a container storing said transmission-type X-ray tube inside thereof and having a transmission window, an electrical insulating liquid filling a space between the container and the transmission-type X-ray tube, and a separating member separating said transmission-type target from said electrical insulating liquid, wherein said tubular shield member has a protruding portion which protrudes outwardly from said envelope so as to contact said electrical insulating liquid, and wherein said separating member is connected to said protruding portion so as to form a thermal insulating portion between said transmission-type target and said electrical insulating liquid.

29. The X-ray generating apparatus according to claim 28, wherein said electrical insulating liquid is an electrical insulating oil.

30. The X-ray generating apparatus according to claim 28, wherein said transmission-type target comprises a transmission plate including diamond.

31. The X-ray generating apparatus according to claim 28, further comprising a voltage control unit for setting a voltage of said transmission type target to +(Va−α) and a voltage of said electron source to -α, where Va>α>0.

32. The X-ray generating apparatus according to claim 28, wherein said thermal insulating portion is defined at a pressure lower than atmospheric pressure.

33. The X-ray generating apparatus according to claim 28, wherein said thermal insulating portion is filled with gas at atmospheric pressure.

34. The X-ray generating apparatus according to claim 28, wherein said separating member is connected to said tubular shield member in a hermetically sealed manner so as to separate said electrical insulating liquid from said thermal insulating portion.

35. The X-ray generating apparatus according to claim 28, wherein said separating member is connected to said tubular shield member in a hermetically sealed manner so as to thermally isolate said electrical insulating liquid from said thermal insulating portion.

36. The X-ray generating apparatus according to claim 28, wherein said separating member is connected to said tubular shield member not to hinder fluidity of said insulating liquid.

37. The X-ray generating apparatus according to claim 28, wherein said separating member is provided in an end portion of said protruding portion of said tubular shield member.

38. The X-ray generating apparatus according to claim 28, wherein said tubular shield member has a protruding portion which protrudes outwardly from said envelope toward said transmission window.

39. The X-ray generating apparatus according to claim 28, further comprising an electron source stored in said envelope, which faces said transmission-type target.

40. The X-ray generating apparatus according to claim 39, wherein said transmission-type target has a target layer for generating X-ray responsive to irradiation with an electron emitted from said electron source.

41. The X-ray generating apparatus according to claim 28, wherein said tubular shield member surrounds said transmission-type target so as to shield a part of the X-ray emitted from said transmission-type target.

42. The X-ray generating apparatus according to claim 28, wherein said separating member allows said electrical insulating liquid to flow across a region between said separating member and said transmission window.

43. The X-ray generating apparatus according to claim 28, wherein said separating member prevents said transmission-type target from contacting said electrical insulating liquid flowing between said transmission-type X-ray tube and said container.

44. A radiography system comprising:

an X-ray generating apparatus according to claim 28;

an X-ray detector for detecting the X-ray emitted from said X-ray generating apparatus and transmitted through an object; and a controlling unit for controlling said X-ray generating apparatus and said X-ray detector.

* * * * *